US009109855B1

(12) United States Patent
Kincel

(10) Patent No.: US 9,109,855 B1
(45) Date of Patent: Aug. 18, 2015

(54) MODULAR BUTTSTOCK ASSEMBLY

(71) Applicant: Bravo Company USA, Inc., Hartland, WI (US)

(72) Inventor: Eric Stephen Kincel, Las Vegas, NV (US)

(73) Assignee: Bravo Company USA, Inc., Hartland, WI (US)

( * ) Notice: Subject to any disclaimer, the term of this patent is extended or adjusted under 35 U.S.C. 154(b) by 0 days.

(21) Appl. No.: 14/256,904

(22) Filed: Apr. 18, 2014

(51) Int. Cl.
*F41C 23/20* (2006.01)
*F41C 23/22* (2006.01)

(52) U.S. Cl.
CPC ..... *F41C 23/20* (2013.01); *F41C 23/22* (2013.01)

(58) Field of Classification Search
CPC ..... F41C 23/22; F41C 23/18; F41C 23/00; F41C 23/20; F41C 23/14; F41C 23/06; F41C 7/00; B29C 45/00; B29C 41/04; F41A 11/00; F41A 11/02; F41A 5/28; B29K 2067/00; B29K 2077/00; B29K 2015/0088
USPC ..... 42/71, 75.01, 75.03
See application file for complete search history.

(56) References Cited

U.S. PATENT DOCUMENTS 3,618,248 A * 11/1971 Into et al. ..... 42/71.01
7,762,018 B1 * 7/2010 Fitzpatrick et al. ..... 42/73
7,762,081 B2 * 7/2010 Williams ..... 60/772
8,397,414 B2 * 3/2013 Walters ..... 42/73

* cited by examiner

*Primary Examiner* — Troy Chambers
*Assistant Examiner* — Bridget Cochran
(74) *Attorney, Agent, or Firm* — Lewis Roca Rothgerber LLP

(57) ABSTRACT

A modular buttstock assembly that removably mounts to a receiver extension of a firearm may include a main body and a rear body. The main body may have a passage that mates with the receiver extension, while the rear body may be removably coupled to the main body such that any number of swappable, modular rear bodies may be coupled to the main body. The main body may include a toggle assembly with a actuating lever coupled to an bowed or ached actuating spring. The toggle assembly may also include a locking block with a plurality of shafts that distribute the load from the receiver extension to the main body rather than concentrating mechanical stress on a single lock pin.

27 Claims, 7 Drawing Sheets

MODULAR BUTTSTOCK ASSEMBLY

BACKGROUND

1. Field of the Disclosure

The present disclosure relates to firearms. More particularly, it concerns a modular buttstock assembly that features enhanced modularity and structural integrity compared to known buttstock designs.

2. Description of the Related Art

Many firearms feature a component called a "buttstock." Alternative terms for the same component include "stock," "shoulder stock," or "butt." The buttstock, which is connected to the firing mechanism and barrel, is typically the most rearward component of a firearm during normal use. The buttstock allows a user to brace the firearm against his or her shoulder and cheek prior to firing. In some applications, such as when a user is firing from a prone position, the buttstock provides support by resting on the ground or other surface. Further, although primarily used for firing ammunition, firearms used by military or law enforcement personnel are sometimes used to apply blunt force to a person (e.g., a combatant) or object (e.g., a glass window). In such cases, the buttstock frequently serves as the striking surface.

Many modern buttstocks are considered "collapsible" or "adjustable" in the sense that a user can alter the distance between the buttstock and the receiver to accommodate his or her needs (e.g., arm length). Inventor Robert Roy introduced the first adjustable buttstock assembly in 1966. Roy's assembly, which still stands as the prevailing adjustable buttstock design, was designed to fit a standard sized receiver extension produced by Colt's Manufacturing Company, LLC of Hartford, Conn. Roy's design utilizes a receiver extension tube containing depressions. The buttstock slides over the receiver extension tube. The bottom of the buttstock contains a lever connected to a lock pin. The lock pin is biased by a conventional wire spring upwards through a passage in the buttstock and into one of the depressions in the received extension tube. When biased into one of the depressions by the spring, the head of the lockpin prevents the buttstock from sliding along the receiver extension tube. When the user wishes to adjust the distance between the buttstock and the receiver, he or she retracts the lockpin from the depression by applying force to the lever protruding from the buttstock. For more details on Roy's design, see U.S. Pat. No. 3,348,328.

Although Roy's design has remained the standard in adjustable buttstocks for many years, it suffers from a severe limitation. Many of the aforementioned applications for which buttstocks are used, such as delivering blunt force to an object or person, inflict mechanical stress on the lockpin, the lever, and the surrounding housing. Similar stresses are applied when firearms featuring traditional buttstocks impact the ground or other surface after being accidentally dropped. As a result, traditional buttstocks featuring Roy's design are overly susceptible to breakage. Customers in the firearm industry are increasingly demanding buttstocks with longer life expectancies. Alternatives to Roy's buttstock design have been attempted, such as the Magpul CTR® Carbine Stock offered by Magpul, Inc. of Boulder, Colo., but they have yet to offer any substantial advantage in structural integrity. Given such limitations, there is a persistent need in the firearm industry for a buttstock assembly that offers enhanced structural integrity.

Known buttstocks are further limited when it comes to offering flexible storage functionality. When regularly using firearms, users commonly need access to a number of accessory items, such as batteries (e.g., for weapon mounted lights, thermal imaging devices, laser sights, etc.), cleaning kits, or replacement parts. Some attempts at offering convenient storage functionality have succeeded to a degree but ultimately constitute inflexible solutions because they rely on permanently integrated storage compartments. One such attempt was the Magpul ACS™ Carbine Stock offered by Magpul, Inc. The presence of a storage compartment, while convenient and desirable in some situations, introduces additional components susceptible to breakage. As a result, users find a buttstock storage compartment desirable in some instances, and undesirable in others. Because existing buttstock offerings are inflexible, users must expend funds purchasing more than one buttstock and then must find sufficient space to store them. Further, users must endure the time-consuming task of swapping out the entire buttstock when transitioning from a scenario in which a buttstock storage compartment is desirable to a scenario in which enhanced mechanical strength is a greater priority, and vice versa. Accordingly, there is a need in the firearm industry for a modular buttstock assembly that offers flexible functionality.

SUMMARY

Embodiments of a modular buttstock assembly that removably mounts to a receiver extension of a firearm are disclosed. In one embodiment, a modular buttstock assembly that removably mounts to a receiver extension of a firearm may include a main body and a rear body. The main body may have a passage that mates with the receiver extension, while the rear body may be removably coupled to the main body. The rear body may include a forward region and a rear region. The forward region may have a recess that slideably mates with the main body. The rear region may have a support surface.

DETAILED DESCRIPTION

Embodiments of a modular buttstock modular that removably mounts to a receiver extension of a firearm are provided.

The modular buttstock assembly features enhanced modularity and structural integrity compared to known buttstock assemblies. Namely, in various embodiments, the modular buttstock assembly may feature an improved toggle assembly. The improved toggle assembly may include a multi-shaft locking block that is far superior in structural integrity to conventional lock pins and a bowed or arched actuating spring that is superior to conventional wire compression springs in structural integrity, elastic memory, wear resistance, and cost-efficiency. In various embodiments, the modular buttstock assembly may also feature a rear body that may be removably coupled to a front body such that any number of swappable, modular rear bodies (e.g., those containing built-in storage compartments or accessories) may be employed to suit particular applications.

Although certain embodiments of a modular buttstock assembly are discussed herein, it should be understood that such embodiments are illustrative only and in no way limit the scope of the present disclosure. Persons of ordinary skill in the art will readily recognize that the present disclosure suggests many other possible embodiments in addition to those expressly described herein.

Figure 1:
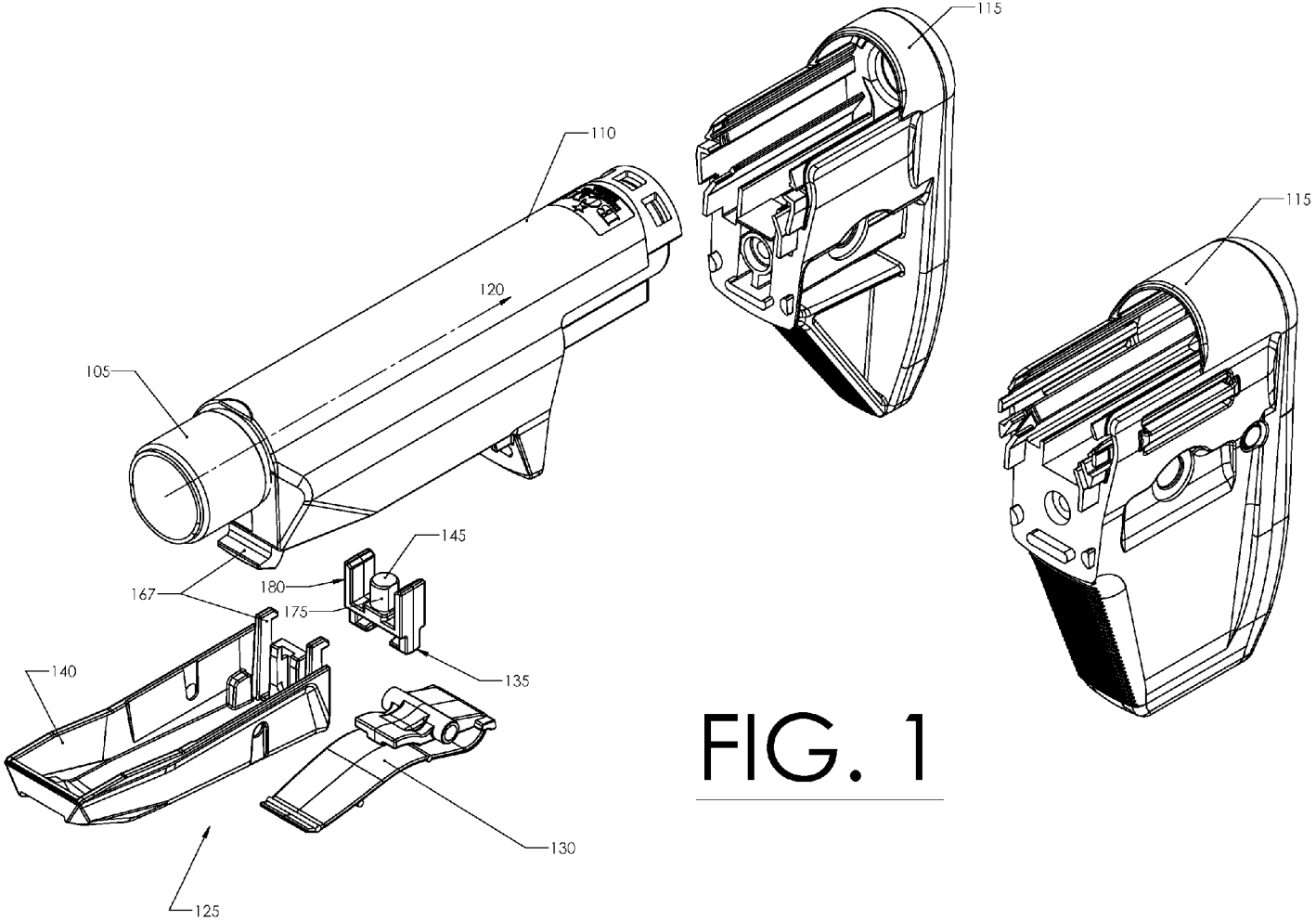
FIG. 1 is an exploded perspective view of an exemplary modular buttstock assembly that removably mounts to a receiver extension of a firearm.

FIG. 1 is an exploded perspective view of an exemplary modular buttstock assembly 100 that removably mounts to a receiver extension 105 of a firearm. As shown in FIG. 1, in one embodiment, a modular buttstock assembly 100 that removably mounts to a receiver extension 105 of a firearm may include a main body 110 and one or more swappable, modular rear bodies 115. Main body 110 may have a passage 120 that slideably mates with receiver extension 105. Rear body 115 may be removably coupled to main body 110. As a result, any number of modular rear bodies 115 may be quickly swapped in and out of modular buttstock assembly 100 to suit a variety of applications and/or missions. Modular buttstock assembly 100 may further include a toggle assembly 125 coupled to main body 110. Toggle assembly 125 may include an actuating spring 130, a locking block 135, and an actuating lever 140. Locking block 135 may be coupled to actuating spring 130. Actuating spring 130 may have a biased position and an unbiased position. Further, as illustrated, actuating spring 130 may be a bowed or arched spring as opposed to a conventional wire compression spring. Actuating spring 130 may be made at least partially of a synthetic polymer, such as a glass-filled reinforced polymer (e.g., nylon). In other embodiments, actuating spring 130 may be made of metal or another suitably resilient material. Actuating lever 140 may be coupled to main body 110 by snap-fitting or other traditional coupling technique. Locking block 135 may include a plurality of shafts 145 aligned with a void (shown in FIG. 3A) disposed in main body 110. In some embodiments, shafts 145 may be non-round shafts.

Figure 2:
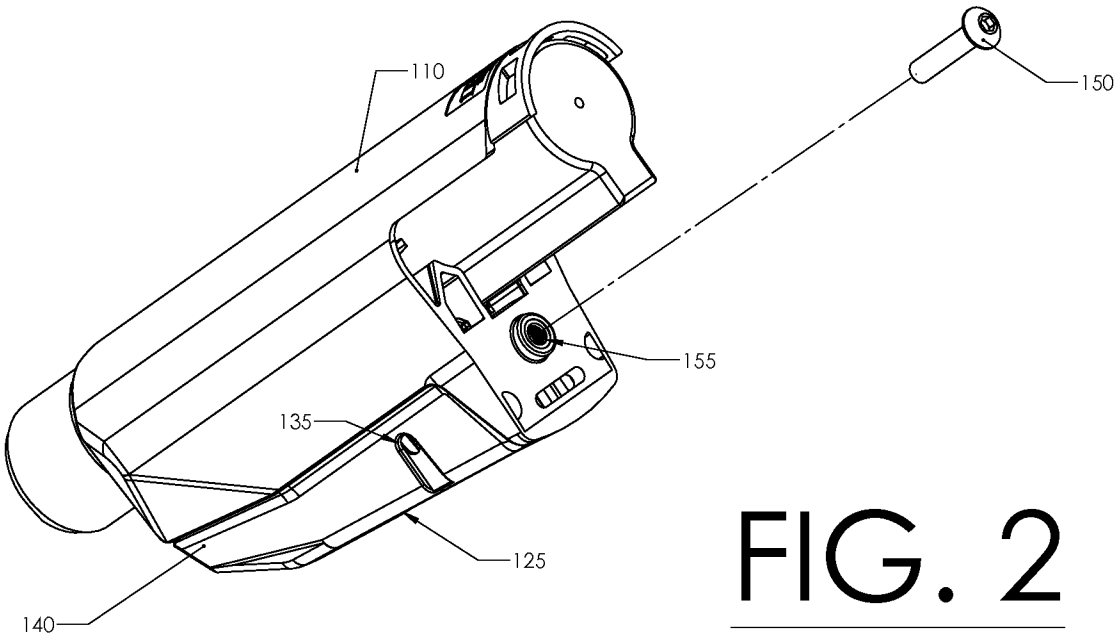
FIG. 2 is a perspective view of an exemplary main body of a modular buttstock assembly that removably mounts to a receiver extension of a firearm.

FIG. 2 is a perspective view of an exemplary main body 110 of a modular buttstock assembly 100 that removably mounts to a receiver extension 105 of a firearm. As previously noted, main body 110 may be removably coupled to one or more swappable, modular rear bodies 115, two examples of which are shown in FIG. 1. As shown in FIG. 2, the removable coupling of main body 110 to a rear body 115 may be facilitated by a fastener 150. Fastener 150 may be a traditional threaded screw, a quick-detachable mechanism such as a press button with a male-female locking tab assembly or the like, or it may be any number of other suitable fasteners known in the art, such as a pin, bolt, clip, latch, retaining ring, or the like. Main body 110 may include a hole 155 into which a first end of fastener 150 may be inserted. FIG. 2 further shows toggle assembly 125 coupled to main body 110, with actuating lever 140 visible and locking block 135 disposed within the interior of main body 110.

Figure 3B:
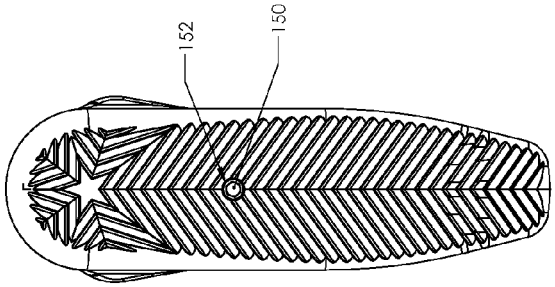
FIG. 3B is a rear view of an exemplary modular buttstock assembly that removably mounts to a receiver extension of a firearm.
Figure 3A:
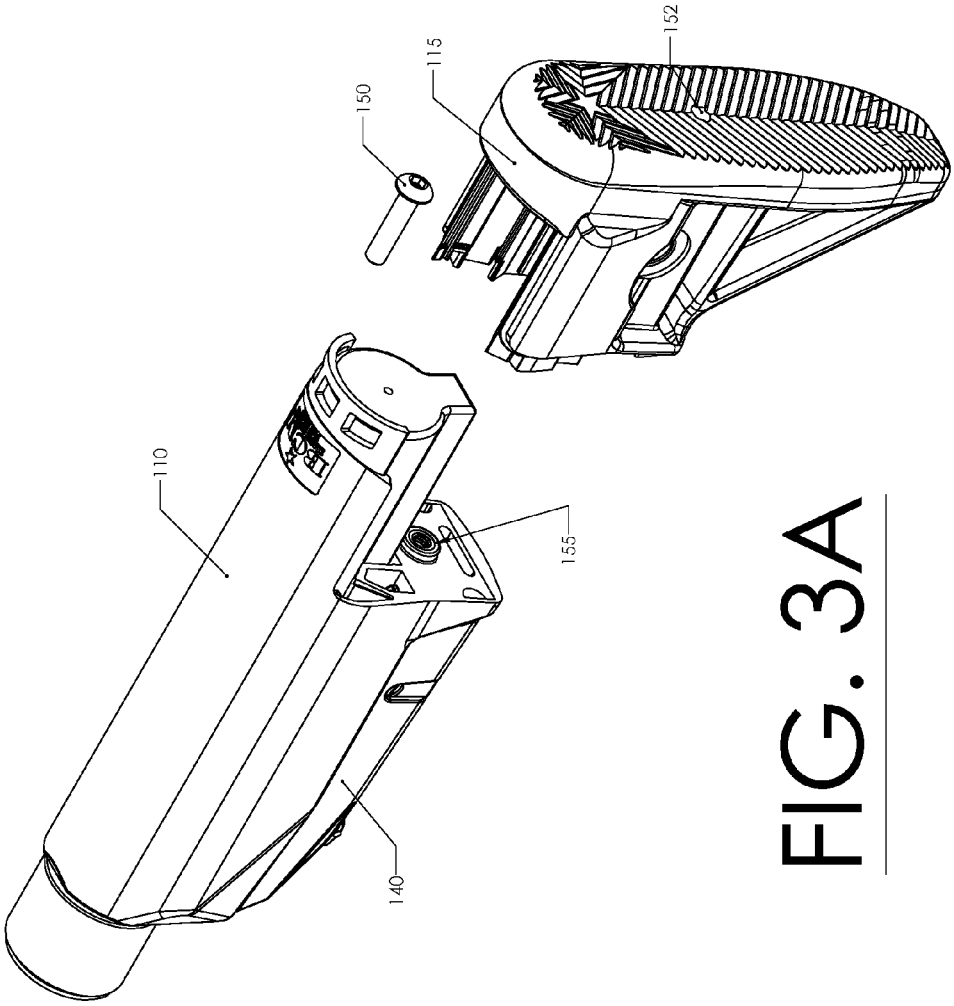
FIG. 3A is a partially exploded perspective view of an exemplary modular buttstock assembly that removably mounts to a receiver extension of a firearm.

FIG. 3A is a partially exploded perspective view of an exemplary modular buttstock assembly 100. Notably, although in FIG. 3A fastener 150 is shown inserted directly into hole 155 of main body 110 for illustrative purposes, in practice fastener 150 passes through an internal passage in rear body 115 before entering hole 155 of main body 110. The diameter of the internal passage may be smaller than a second end or head of fastener 150 such that fastener 150 may not pass entirely through the internal passage in rear body 115. As a result, the second end or head of fastener 150 may be tightened against an internal surface of rear body 115 to securely yet removably couple rear body 115 to main body 110. As previously noted, in other embodiments a variety of other coupling mechanisms may be used. Fastener 150 may be accessed from the rear of rear body 115 through a hole 152 (also shown in FIG. 3B).

FIG. 3B is a rear view of an exemplary modular buttstock assembly 100. As shown in FIG. 3B, in one embodiment, fastener 150 may be accessed from the rear of modular buttstock assembly 100 through hole 152. Using a tool, the user may access and release fastener 150 to uncouple rear body 115 from main body 110. In other embodiments, fastener 150 may be accessed from other locations throughout modular buttstock assembly 100.

Figure 4A:
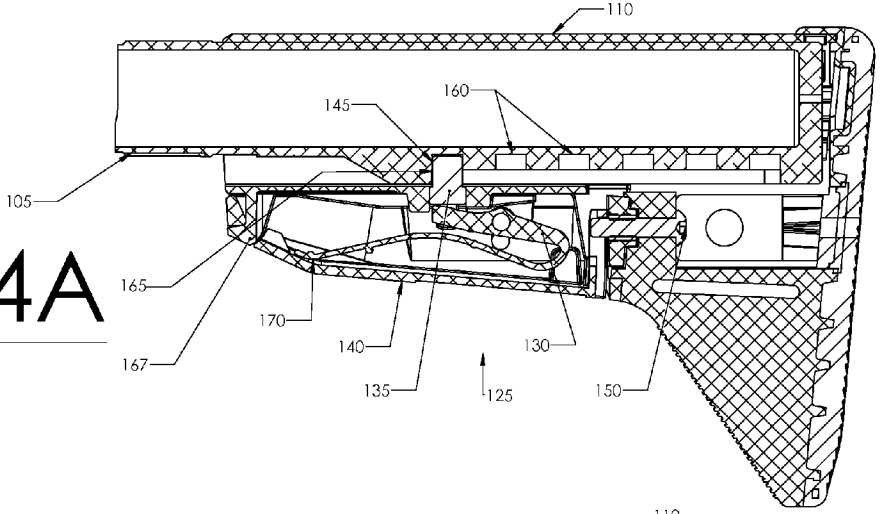
FIG. 4A is a sectional view of an exemplary modular buttstock assembly that removably mounts to a receiver extension of a firearm.

FIG. 4A is a sectional view of an exemplary modular buttstock assembly 100 that removably mounts to a receiver extension 105 of a firearm. As shown in FIG. 4A, a receiver extension 105 is inserted into and mated with passage 120 of main body 110. As is common with known receiver extensions, receiver extension 105 includes one or more downwardly oriented depressions 160. In the example shown in FIG. 4A, receiver extension 105 contains six depressions 160 that allow the user to adjust the distance between modular buttstock assembly 100 and the receiver of the firearm. Main body 105 may contain a void 165 through which locking block 135 of toggle assembly 125 may protrude into passage 120. Actuating spring 130 may be coupled to actuating lever 140, while actuating lever 140 may in turn be coupled to main body 110. Actuating spring 130 may further be coupled to locking block 135, which in turn may be aligned with void 165 leading into passage 120 where receiver extension 105 resides. As discussed further below, when locking block 135 is aligned with void 165 leading into passage 120, shafts 145 of locking block 135 may be forced upwardly by actuating spring 130 through void 165 and into depression 160 of receiver extension 105.

Actuating lever 140 may serve as the surface through which actuating spring 130 may be indirectly operated by a user when toggle assembly 125 is fully assembled and coupled to main body 110. As such, actuating lever 140 may serve as the manual mechanism through which the user ultimately adjusts the distance between modular buttstock assembly 100 and the receiver of the firearm. To that end, actuating lever 140 may feature a region with a more aggressive or pronounced surface texture compared to other parts of modular buttstock assembly 100. The more aggressive texture may assist the user in quickly locating and firmly gripping actuating lever 140. In some embodiments, actuating lever 140 may be coupled to main body 110 through one or more hooks 167 disposed on actuating lever 140 and main body 110 (also shown in FIG. 1). Hooks 167 permit actuating lever 140 to be pressed inwardly into main body 110 such that actuating spring 130 may be forced into its unbiased position by an internal surface of actuating lever 140. In such embodiments, when the user releases actuating lever 140, thereby allowing actuating spring 130 to return to its biased position, hooks 167 catch actuating lever 140 and prevent it from being forced beyond its proper resting position by actuating spring 130.

As shown in FIG. 4A, actuating spring 130 may be shaped as a bowed or arched spring that is coupled to actuating lever 140 and locking block 135. In other embodiments, actuating spring 130 may be a different shape, so long as the shape allows actuating spring 130 to effectively function as a spring. In some embodiments, actuating spring 130 may be made at least partially of a polymer, such as a glass-filled reinforced polymer (e.g. nylon). In embodiments in which actuating spring 130 features a bowed or arched shape and is made of at least partially of a polymer, actuating spring 130 is far superior to conventional wire compression springs in structural integrity, elastic memory, wear resistance, and cost-efficiency. In other embodiments, actuating spring 130 may be made of metal or any other suitably resilient material. By simultaneously serving as both the spring that biases locking block 135 into an engaged position with receiver extension 105 and the member through which force is translated to actuating spring 130 by actuating lever 140, the design of actuating spring 130 eliminates the need for the conventional two-part lock pin system featuring a separate member attached to a conventional wire compression spring. In doing so, the design of actuating spring 130 reduces manufacturing costs and complexity, while at the same time reducing the number of mechanical failure points.

Because actuating spring 130 may serve as a biasing spring when coupled to actuating lever 140, actuating spring 130 may assume either a spring-biased position and an unbiased position. In an embodiment, actuating spring 130 may be maintained in the biased position by upward forces applied by an interior wall of actuating lever 140. In addition to providing just enough pressure to retain actuating spring 130 in the biased position, actuating lever 140 may also provide sufficient pressure to prevent locking block 135 and actuating spring 130 from rattling inside main body 110 when the user is moving. Such embodiments provide superior wear resistance and stealth capabilities compared to conventional designs featuring wire compression springs and lock pins.

When actuating spring 130 is in the biased position, actuating spring 130 may force locking block 135 upwardly through void 165 and into depression 160 of receiver extension 105. When locking block 135 is forced into depression 160, one or more of shafts 145 may abuttedly engage an interior wall of depression 160 as shown in FIG. 3A. As a result, locking block 135 may obstruct receiver extension 105 from sliding within passage 120 of main body 110. When actuating spring 130 is forced into the unbiased position by way of the user depressing a rear portion of actuating lever 140, locking block 135, by virtue of being coupled to actuating spring 130, may be retracted from depression 160 of receiver extension 105 such that one or more of shafts 145 no longer abuttedly engage an interior wall of depression 160. As a result, when actuating lever 140 is depressed and actuating spring 130 is forced into the unbiased position, locking block 135 no longer obstructs the ability of receiver extension 105 to slide within passage 120 of main body 110. Thus, in operation, to adjust the distance between modular buttstock assembly 100 and the receiver of the firearm, the user need only depress a portion of actuating lever 140, slide modular buttstock assembly 100 along receiver extension 105, and release actuating lever 140 when locking block 135 is aligned with a depression 160.

Upon releasing actuating lever 140, the force indirectly applied by the user to actuating spring 130 to shift actuating spring 130 into its unbiased position is removed. As a result, actuating spring 130 returns to its biased position and once again holds modular buttstock assembly 100 securely in place along the length of receiver extension 105 when locking block is properly realigned with a depression 160 in receiver extension 105. In some instances, the user may inadvertently release actuating lever 140 when locking block 135 is not perfectly aligned with a depression 160 in receiver extension 105. In such cases, the user can feel the resistance in actuating spring 130 and may make slight slide adjustments to the position of modular buttstock assembly 100 until locking block 135 becomes aligned with a depression 160 and actuating spring 130, as a result of being maintained in the biased position by actuating lever 140, automatically forces locking block 135 into depression 160.

Referring back to FIG. 1, in an embodiment, the one or more shafts 145 of locking block 135 may include a center locking plunger 175 and a plurality of side flanges 180. Locking plunger 175 may be thicker than side flanges 180 and may have a substantially flat upper surface to facilitate abuttedly engaging an interior wall of depression 160 in receiver extension 105. Alternatively, the upper surface of locking plunger 175 may be textured or ribbed to facilitate friction between the upper surface and the interior wall of depression 160. Side flanges 180 may likewise abuttedly engage the interior wall of depression 160, thereby orienting lock plunger 175, reducing the overall height of locking block 135 compared to convention lock pins, and transferring the load from receiver extension 105 to main body 110. By transferring the load from receiver extension 105 to main body 110, side flanges 180 effectively reduce the stress that is, in conventional lock pin designs, becomes concentrated on the lock pin and eventually causes the pin to break. In some embodiments, like that shown in FIG. 1, locking plunger 175 and side flanges 180 may be a single-piece component (e.g. locking block 135) rather than multiple distinct pieces attached to one another. As a result, in such embodiments, locking block 135 may possess enhanced structural integrity. In other embodiments, however, locking block 135 may be multiple distinct pieces attached to one another.

Figure 4B:
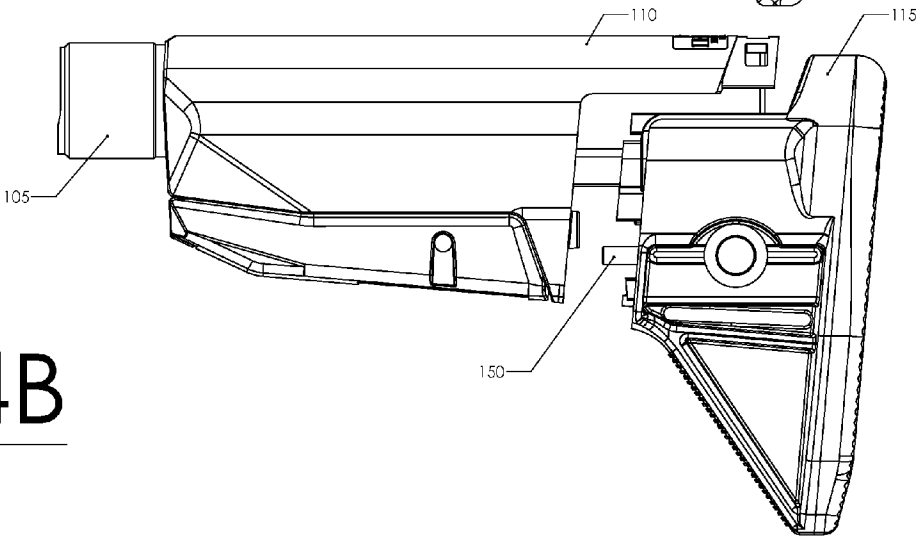
FIG. 4B is a side view of an exemplary modular buttstock assembly that removably mounts to a receiver extension of a firearm.
Figure 5:
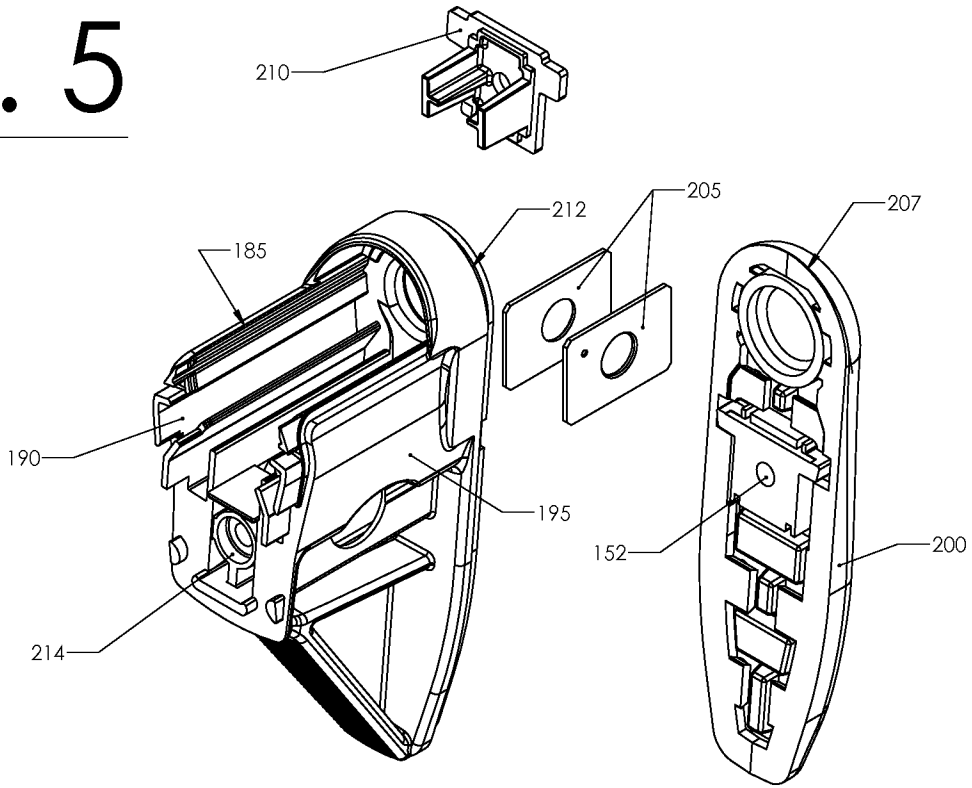
FIG. 5 is an exploded perspective view of an exemplary rear body of a modular buttstock assembly that removably mounts to a receiver extension of a firearm.

FIG. 4B is a side view of an exemplary modular buttstock assembly 100 that removably mounts to a receiver extension 105 of a firearm. As shown in FIG. 3B, main body 110, which may be removably coupled to one or more swappable, modular rear bodies 115, is aligned with but not yet coupled to one such rear body 115. As likewise shown in FIG. 1, main body 110 and rear body 115 may contain one or more corresponding rails and channels that slideably interface. Main body 110 and rear body 115 may be removably coupled by fastener 150 (also shown in and discussed with reference to FIGS. 2, 3A, and 3B). When fastener 150 is removed, rear body 115 may be quickly swapped out for a different modular rear body 115. In some embodiments, removing fastener 150 or otherwise decoupling main body 110 from rear body 115 may necessitate the use of a tool. As discussed below in further detail, in some embodiments rear body 115 may include a storage compartment. Among other items and accessories, the storage compartment may store the tool required for the decoupling process. For example, the storage compartment may store a small hex key or other tool for quickly removing fastener 150 when the user desires to swap out modular rear body 115, FIG. 5 is an exploded perspective view of an exemplary rear body 115 of a modular buttstock assembly 100. As shown in FIG. 5, rear body 115 may include a forward region 185 having a recess 190 that slideably mates with a main body of a modular buttstock assembly, such as main body 110 shown in FIGS. 1-4B.

Rear body 115 may further include a rear region 195 having a support surface 200. In some embodiments, support surface 200 may be a buttpad. When rear body 115 is coupled to a main body 110 of a modular buttstock assembly 100, which itself is coupled to a receiver extension 105 of a firearm, buttpad 200 may serve as the rearward-most surface of the fully assembled firearm. As a result, among other uses, buttstock 200 may allow a user to brace the firearm against his or her shoulder and cheek prior to firing or may serve as a striking surface for applying blunt force. Buttpad 200 may be coupled to rear region 195 of rear body 115 through well-known manufacturing processes such as over-molding. Persons of ordinary skill in the art will readily recognize that a wide variety of coupling mechanisms may be used with various embodiments disclosed herein.

Forward region 185 of rear body 115 may include a built-in sling mounting point to which a sling may be mounted. The sling mounted point may include one or more brackets 205 that are secured to forward region 185 of rear body 115 by a plug 210. In an embodiment, one or more brackets 205 may be installed within corresponding grooves, slots, indents, or the like of forward region 185. Plug 210, which may include a plurality of arms, may then be installed behind brackets 205 with respect to forward region 185 such that plug 210 exerts a forward force upon brackets 205 and helps to retain them securely in place within the corresponding grooves, slots, indents, or the like of forward region 185. Buttpad 200 may then be coupled to rear region 195 before the entire rear region 195 is over-molded to add further structural rigidity to the foregoing assembly. In some embodiments, buttpad 200 may include a first lip 207 that corresponds to a second lip 212 disposed at the rearward edge of rear region 195. Lip 207 of buttpad 200 and lip 212 of rear region 195 may interlock to help retain buttpad in place against rear region 195 prior to overmolding.

As discussed with respect to FIGS. 4A and 4B, in some embodiments fastener 150 may be accessible from a hole 152 in buttpad 200 and may pass through an internal passage in rear body 115 before entering hole 155 of main body 110. Hole 152 is further shown in FIG. 5. Moreover, the internal passage through which fastener 150 may be accessed may include the space between brackets 205, the hole depicted in plug 210, and hole 214 in forward region 185 of rear body 115. Hole 214 may be have a smaller diameter than a head of fastener 150 such that the head of fastener 150 may not pass beyond hole 214. As a result, fastener 150 may be tightened against the internal surface surrounding hole 214 to securely yet removably couple rear body 115 to main body 110.

Figure 6:
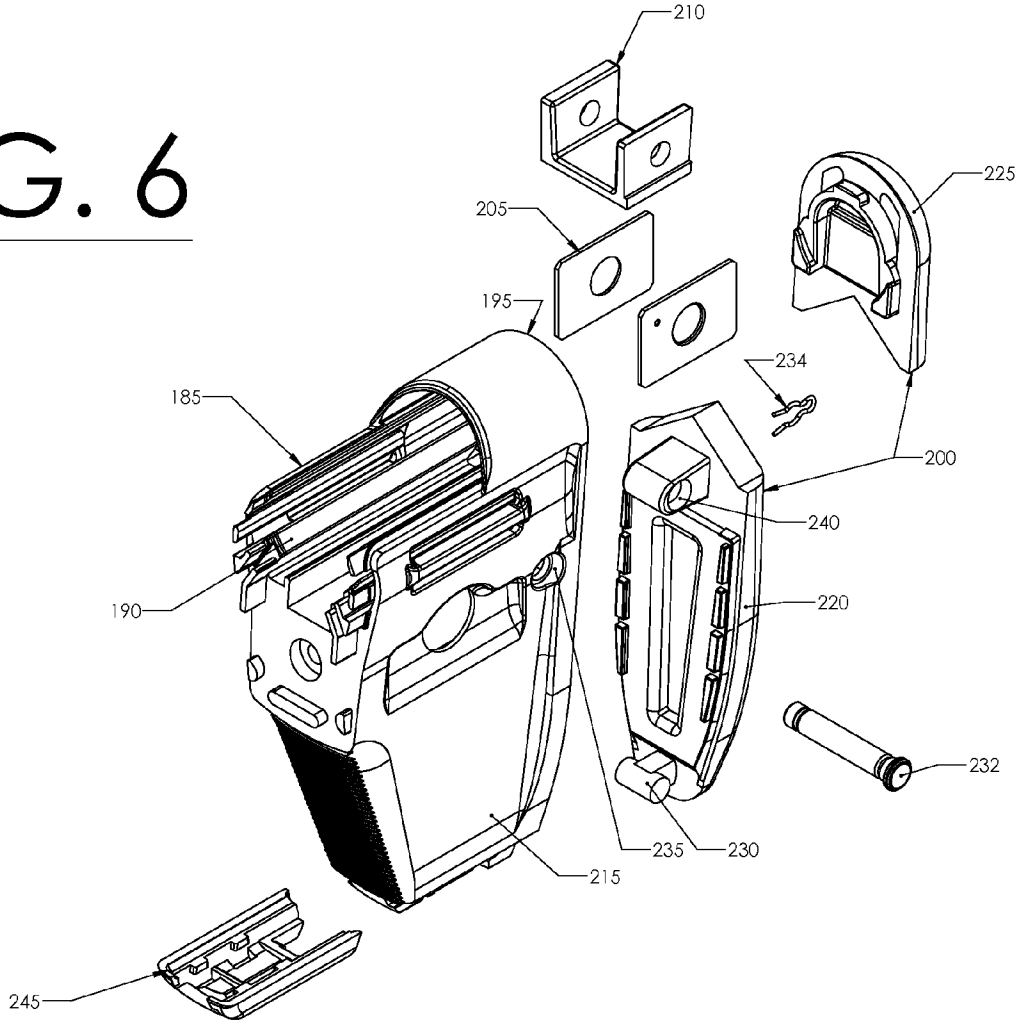
FIG. 6 is an exploded perspective view of another exemplary rear body of a modular buttstock assembly that removably mounts to a receiver extension of a firearm.

FIG. 6 is an exploded perspective view of another exemplary rear body 115 of a modular buttstock assembly 100. As shown in FIG. 5, rear body 115 may include a forward region 185 having a recess 190 that slideably mates with a main body 110 of a modular buttstock assembly 100, such as main body 110 shown in FIGS. 1-4B. Forward region 185 of rear body 115 may include a storage compartment 215. In an embodiment, storage compartment 215 may be a hollow space in the interior of rear body 115. Rear body 115 may further include a rear region 195 having a support surface 200. Support surface 200 may be a buttpad. In some embodiments, buttpad 200 may be segmented into a first buttpad section 220 and a second buttpad section 225. In addition to serving normal functions associated with a buttpad, first buttpad section 220 may additionally be coupled to rear region 195 and may serve as a hinged panel or otherwise moveable barrier through which the user may access storage compartment 215. For instance, in the embodiment shown in FIG. 5, first buttpad section 220 may include a hinge 230 and may be hingedly coupled to front region 185 of rear body 115.

Second buttpad section 225 may be fixed such that less than all of buttpad 200 provides access to storage compartment 215. Alternatively, buttpad 200 may be a single unit akin to a traditional buttpad, except that the entire buttpad may be hingedly coupled to rear region 195. Buttpad 200 may be retained in place by a pin 232 and a retaining clip 234. Retaining clip 234 may be a hair clip or any other fastener suitable for retaining pin 232 in place. Rear region 195 of rear body 115 may include a hole 235 that corresponds to pin 232 in shape and diameter. Buttpad 200 may include a similarly shaped and sized hole 240. When buttpad 200 is positioned flush against a rearmost surface of rear region 195, hole 235 of rear region 195 and hole 240 of buttpad 200 may align with one another to form a continuous passage that accommodates the length of pin 232. When pin 232 is inserted into the continuous passage, buttpad 200 is retained securely in place against rear region 195 of rear body 115. Retaining clip 234 may pressure fit over a corresponding groove disposed near a first end of pin 232 and into a groove disposed in rear region 195. In such embodiments, when retaining clip 234 is coupled to rear region 195 over pin 232, pin 232 is held securely in place within the continuous passage formed by hole 235 of rear region 195 and hole 240 of buttpad 200. In addition to the groove corresponding to retaining clip 234, pin 232 may further include a second end with a notch that obstructively prevents pin 232 from passing completely through the continuous passage formed by hole 235 of rear region 195 and hole 240 of buttpad 200.

In some embodiments, second buttpad section 225 may include a first lip that interlocks with a second lip disposed on an edge of rear region 195, much like first lip 207 and second lip 212 shown in FIG. 5. In other embodiments, a variety of other mating mechanisms may be used, such as corresponding rings or snap-fit components. First buttpad section 220 may further include an angled edge 242 that corresponds to an correspondingly angled edge 244 of second buttpad section 225. As a result, when coupled to rear region 195, first buttpad section 220 may drive second buttpad section 220 upwards against lip 236 of rear region 195. In doing so, second buttpad section 220 assists in securing first buttpad section 220 to rear region 195 and in reducing the likelihood that second buttpad section 200 will rattle when modular buttstock assembly 100 is subject to motion.

Forward region 185 may further include a cover 245 coupled to a bottom surface of rear body 115. Cover 245 may serve to conceal hinge 230 from view when buttpad 200 is hingedly coupled to rear region 195 so as to give rear body 115 a sleek, low profile appearance. Cover 245 may also serve as a locking member that couples to hinge 230 and may shield hinge 230 from debris that might otherwise impede the ability of first buttpad section 220 to pivot around hinge 230. Forward region 185 may further include a built-in sling mounting point to which a sling may be mounted. The sling mounted point may include one or more brackets 205 that are secured to forward region 185 of rear body 115 by a plug 210. In an embodiment, one or more brackets 205 may be installed within corresponding groove, slots, indents, or the like of forward region 185. Plug 210, which may include a plurality of arms, may then be installed in between brackets 205 such that the arms exert outward pressure on brackets 205 and effectively pin them in place against a section of forward region 185. Buttpad 200 may then be over-molded and/or hingedly coupled to rear region 195.

Figure 7:
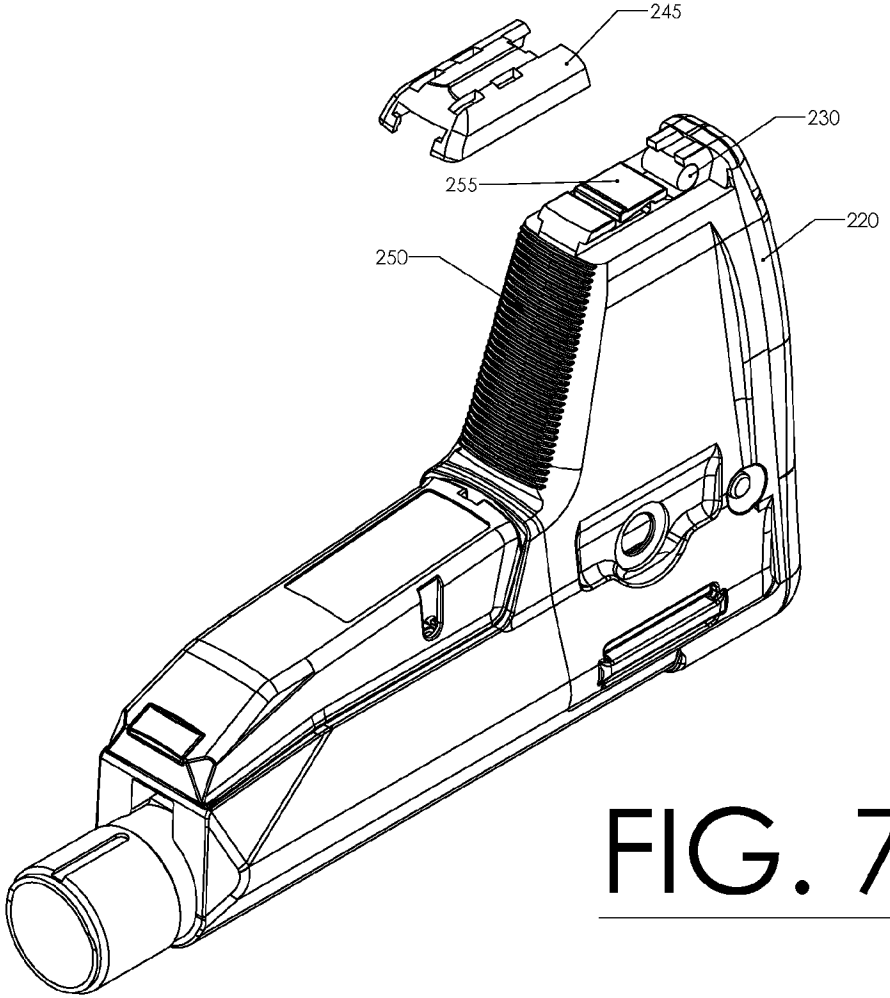
FIG. 7 is a partially exploded, inverted perspective view of an exemplary modular buttstock assembly that removably mounts to a receiver extension of a firearm.

FIG. 7 is a partially exploded, inverted perspective view of an exemplary modular buttstock assembly 100. As shown in FIG. 6, cover 245 conceals hinge 230 of first buttpad section 220. Cover 245 may be coupled to rear body 115 by a tab disposed on the internal surface of cover 245 (not shown) that interlocks with a spring member 255. In some embodiments, cover 245 may include a gap through which a bullet tip or other small object may be inserted to actuate spring member 255 and release cover 245. Rear body 115 may also include one or more textured surfaces 250. Textured surface 250 may aesthetically enhance rear body 115, provide increased wear resistance, and provide a non-slip surface for situations in which the user may need to carry the firearm by rear body 115.

Although certain embodiments of rear bodies 115 have been described herein, persons of ordinary skill in the art will readily recognize that such disclosure is in no way limiting. On the contrary, in light of the disclosure provided herein, it should be readily apparent to persons of ordinary skill in the art that the present disclosure covers a wide variety of swappable, modular rear bodies 115, such as those featuring a variety of storage compartments, access panels, or built-in accessories.

The above description is illustrative and not restrictive. Many variations of the invention will become apparent to those of skill in the art upon review of this disclosure. While the present invention has been described in connection with a variety of embodiments, these descriptions are not intended to limit the scope of the invention to the particular forms set forth herein. To the contrary, the present descriptions are intended to cover alternatives, modifications, and equivalents as may be included within the spirit and scope of the invention as defined by the appended claim and otherwise appreciated by one of ordinary skill in the art.

What is claimed is:

1. A modular buttstock assembly that removably mounts to a receiver extension of a firearm, the modular buttstock assembly comprising:
- a main body comprising:
  - a passage that mates with the receiver extension of the firearm, and
  - a toggle assembly comprising:
    - an actuating spring having a biased position and an unbiased position, and
    - a locking block coupled to the actuating spring; and
- a rear body removably coupled to the main body, wherein no part of the toggle assembly is disposed within the rear body.

2. The modular buttstock assembly of claim 1, wherein an entirety of the toggle assembly remains coupled to the main body when the rear body is uncoupled from the main body.

3. The modular buttstock assembly of claim 1, wherein the toggle assembly is disposed within the main body.

4. The modular buttstock assembly of claim 1, wherein the actuating spring is a bowed actuating spring.

5. The modular buttstock assembly of claim 4, wherein the bowed actuating spring is made at least partially of a polymer.

6. The modular buttstock assembly of claim 1, wherein the locking block includes a first disposed between a plurality of side shafts.

7. The modular buttstock assembly of claim 6, wherein each of the plurality of shafts is abuttedly engaged with the receiver extension of the firearm when the actuating spring is in the biased position.

8. The modular buttstock assembly of claim 6, wherein none of the plurality of shafts is engaged with the receiver extension of the firearm when the actuating spring is in the unbiased position.

9. The modular buttstock assembly of claim 6, wherein the first shaft is a locking plunger and the plurality of side shafts include a plurality of flat surfaces.

10. The modular buttstock assembly of claim 9, wherein the locking plunger is abuttedly engaged with the receiver extension of the firearm at a void disposed in the receiver extension and the plurality of side shafts are each abuttedly engaged against a flat outer surface of a non-cylindrical portion of the receiver extension when the actuating spring is in the biased position.

11. The modular buttstock assembly of claim 9, wherein the locking plunger and the side shafts are not abuttedly engaged with the receiver extension of the firearm when the actuating spring is in the unbiased position.

12. The modular buttstock assembly of claim 9, wherein the locking plunger and the plurality of side flanges are constructed as a single collective component.

13. The modular buttstock assembly of claim 1, wherein the rear body includes a buttpad.

14. The modular buttstock assembly of claim 1, wherein the rear body includes a sling mounting point.

15. The modular buttstock assembly of claim 1, wherein the rear body includes a storage compartment.

16. The modular buttstock assembly of claim 15, wherein the storage compartment is accessible by a hinged panel disposed at a rear surface of the rear body.

17. The modular buttstock assembly of claim 16, wherein the hinged panel includes at least a portion of a buttpad.

18. The modular buttstock assembly of claim 16, wherein the hinged panel is retained in a closed position by a pin removably coupled to the main body.

19. A modular buttstock assembly that removably mounts to a receiver extension of a firearm, the modular buttstock assembly comprising:
- a main body comprising:
  - a passage that mates with the receiver extension of the firearm, and
  - a toggle assembly comprising:
    - a bowed actuating spring having a biased position and an unbiased position,
    - a locking block coupled to the actuating spring, and
    - an actuating lever abuttedly engaged with the actuating spring when the actuating spring is in the unbiased position; and
- a rear body removably coupled to the main body.

20. The modular buttstock assembly of claim 1, wherein the passage of the main body mates with a non-cylindrical portion of the receiver extension.

21. The modular buttstock assembly of claim 19, wherein the passage of the main body mates with the receiver extension of the firearm when a portion of the receiver extension is non-cylindrical.

22. The modular buttstock assembly of claim 19, wherein the actuating lever is substantially flat and free of protrusions with respect to the main body.

23. The modular buttstock assembly of claim 19, wherein the locking block includes a first shaft disposed between a plurality of side shafts, and wherein the first shaft is abuttedly engaged with the receiver extension of the firearm at a void disposed in the receiver extension and the plurality of side shafts are each abuttedly engaged against a flat outer surface of a non-cylindrical portion of the receiver extension when the actuating spring is in the biased position.

24. A modular buttstock assembly that removably mounts to a receiver extension of a firearm, the modular buttstock assembly comprising:

a main body comprising:

a passage that mates with the receiver extension of the firearm, and a toggle assembly comprising:

a bowed actuating spring having a biased position and an unbiased position, and a locking block coupled to the bowed actuating spring and abuttedly engaged with a void disposed in the receiver extension of the firearm when the bowed actuating spring is in the biased position, wherein the bowed actuating spring pivots the locking block out of engagement with the receiver extension of the firearm when the bowed actuating spring is moved into the unbiased position; and a rear body removably coupled to the main body.

25. The modular buttstock assembly of claim 24, wherein the bowed actuating spring pivots the locking block along an axis perpendicular to a longitudinal axis of the passage of the main body.

26. The modular buttstock assembly of claim 24, wherein the locking block includes a first shaft disposed between a plurality of side shafts.

27. The modular buttstock assembly of claim 26, wherein the first shaft is abuttedly engaged with the receiver extension of the firearm at a void disposed in the receiver extension and the plurality of side shafts are each abuttedly engaged against a flat outer surface of a non-cylindrical portion of the receiver extension when the actuating spring is in the biased position.

* * * * *